US009550204B2

(12) United States Patent
Lanier

(10) Patent No.: US 9,550,204 B2
(45) Date of Patent: Jan. 24, 2017

(54) METHOD FOR DISPENSING AN ADHESIVE

(71) Applicant: Nordson Corporation, Westlake, OH (US)

(72) Inventor: Leonard J. Lanier, Johns Creek, GA (US)

(73) Assignee: Nordson Corporation, Westlake, OH (US)

( * ) Notice: Subject to any disclaimer, the term of this patent is extended or adjusted under 35 U.S.C. 154(b) by 92 days.

(21) Appl. No.: 14/794,248

(22) Filed: Jul. 8, 2015

(65) Prior Publication Data

US 2015/0306626 A1 Oct. 29, 2015

Related U.S. Application Data

(62) Division of application No. 14/068,936, filed on Oct. 31, 2013, now Pat. No. 9,126,223.

(51) Int. Cl.
*B05C 5/02* (2006.01)
*B05B 15/02* (2006.01)
*B05B 1/30* (2006.01)

(52) U.S. Cl.
CPC ..... *B05C 5/0229* (2013.01); *B05B 15/0233* (2013.01); *B05C 5/0225* (2013.01); *B05B 1/3046* (2013.01)

(58) Field of Classification Search
CPC ..... B05C 5/0229; B05C 5/02; B05C 5/0225; B05B 15/0233; B05B 1/28; B05B 1/30; B05B 1/3013; B05B 1/302; B05B 1/3026; B05B 1/3033; B05B 1/304; B05B 1/3046; B05B 1/306; B05B 15/02; F16K 23/00
(Continued)

(56) References Cited

U.S. PATENT DOCUMENTS 2,594,045 A * 4/1952 Loepsinger ..... B05B 7/067 239/412
2,746,800 A * 5/1956 Voit ..... F02M 61/06 239/584

(Continued)

FOREIGN PATENT DOCUMENTS

WO 9014898 A1 12/1990
WO 2008078044 A2 7/2008
WO 2012158494 A1 11/2012

OTHER PUBLICATIONS

European Patent Office, International Search Report and Written Opinion in PCT Application No. PCT/US2014/057342, Dec. 3, 2014.

*Primary Examiner* — Patrick M Buechner
(74) *Attorney, Agent, or Firm* — Baker & Hostetler LLP

(57) ABSTRACT

A dispensing module and method of dispensing an adhesive includes a dispenser body assembly having a liquid supply passage, a nozzle member having a liquid passageway, a valve element, and a valve seat. The liquid passageway includes a discharge passageway defining an outlet, a first converging surface, a bore, and a shoulder positioned between the first converging surface and the bore. The valve element extends along an axis within the liquid passageway and has a bulbous end portion movable along the axis between an open position and a closed position. The bulbous end portion has a valve needle smaller than the bore to inhibit obstruction to the discharge passageway for adhesive flowing thereto. The valve seat seals against the bulbous end portion in the closed position such that a region of the valve needle projects into the discharge passageway for inhibiting clogging of the adhesive proximate to the outlet.

4 Claims, 5 Drawing Sheets

(58) Field of Classification Search
USPC ... 222/504, 559, 571; 251/62, 63, 63.5, 332, 251/333, 903
See application file for complete search history.

(56) References Cited

U.S. PATENT DOCUMENTS

| | | | | | |
|---|---|---|---|---|---|
| 3,035,780 | A * | 5/1962 | Peras | F02M 61/06 | 239/453 |
| 3,243,156 | A * | 3/1966 | Shoemaker | F16K 31/1223 | 251/63 |
| 3,343,721 | A | 9/1967 | Paley | | |
| 3,415,427 | A * | 12/1968 | Sharp | B22D 41/16 | 222/591 |
| 3,791,590 | A * | 2/1974 | Dieter | B05B 1/28 | 222/501 |
| 3,827,604 | A | 8/1974 | Hamilton et al. | | |
| 3,952,927 | A | 4/1976 | Schaumburg et al. | | |
| 3,958,730 | A | 5/1976 | Caldwell | | |
| 4,271,994 | A | 6/1981 | Seaton | | |
| 4,283,012 | A * | 8/1981 | Hanson | A23G 3/2092 | 118/17 |
| 4,579,255 | A | 4/1986 | Frates et al. | | |
| 4,673,162 | A * | 6/1987 | Lachmann | F16K 31/383 | 137/614.11 |
| 4,891,249 | A | 1/1990 | McIntyre | | |
| 5,194,115 | A * | 3/1993 | Ramspeck | B05B 7/0861 | 156/290 |
| 5,228,604 | A | 7/1993 | Zanini et al. | | |
| 5,261,610 | A | 11/1993 | Waryu et al. | | |
| 5,447,254 | A | 9/1995 | Hoover et al. | | |
| 5,598,974 | A | 2/1997 | Lewis et al. | | |
| 5,747,102 | A | 5/1998 | Smith et al. | | |
| 5,873,528 | A | 2/1999 | Lewis et al. | | |
| 6,135,523 | A | 10/2000 | Pratt | | |
| 6,250,516 | B1 | 6/2001 | Story et al. | | |
| 6,270,019 | B1 | 8/2001 | Reighard | | |
| 6,409,055 | B1 | 6/2002 | Officier | | |
| 6,546,970 | B2 | 4/2003 | Gatteschi | | |
| 6,971,405 | B2 | 12/2005 | Pickelman | | |
| 6,986,739 | B2 | 1/2006 | Warren et al. | | |
| 7,156,267 | B2 * | 1/2007 | Zanga | B67C 3/281 | 141/146 |
| 7,661,651 | B2 | 2/2010 | Kronholm | | |
| 8,069,653 | B2 | 12/2011 | Ganzer | | |
| 8,333,307 | B2 | 12/2012 | Chastine et al. | | |
| 2003/0132413 | A1 | 7/2003 | Boecking | | |
| 2004/0074994 | A1 | 4/2004 | Ganzer | | |
| 2009/0166386 | A1 | 7/2009 | Morand | | |
| 2012/0168652 | A1 | 7/2012 | Saine | | |
| 2013/0105524 | A1 | 5/2013 | Saine | | |

* cited by examiner

METHOD FOR DISPENSING AN ADHESIVE

CROSS-REFERENCE TO RELATED APPLICATION

This application is a divisional of application Ser. No. 14/068,936, filed Oct. 31, 2013 (pending), the disclosure of which is hereby incorporated by reference herein.

TECHNICAL FIELD

The present invention relates generally to a dispensing module for dispensing viscous liquids and, more particularly, to a dispensing module for dispensing an adhesive.

BACKGROUND

Dispensing modules are commonly used to dispense viscous liquids, such as hot melt adhesives, in a variety of dispensing applications employed in the manufacture of products and in product packaging. Conventional dispensing modules are provided with either electrically actuated or electro-pneumatically actuated valve assemblies that regulate the flow and discharge of adhesive from the dispensing module. Typically, the valve assembly incorporates a valve element that is movable to a valve seat between open and closed positions. In the closed position, the valve member seals against the valve seat with a continuous line of contact to discontinue a flow of the adhesive from an outlet of the dispensing module. Cyclical movement of the valve element between the open and closed positions intermittently interrupts the flow to generate a pattern of adhesive on a receiving surface of the product or product packaging.

In many instances, the pattern includes one or more "beads" of the adhesive. The term "bead" generally refers to a continuous discharge of the adhesive, or any other viscous liquid, on the receiving surface with a desirable length, height, width, or other dimension. While the dimensions may vary given the particular application, the ability to repeatedly, accurately, and precisely initiate and terminate the bead provides a manufacturer with the best opportunity to efficiently position each bead on the receiving surface without waste. For example, there are many applications in which it is desirable or necessary to sharply cut off flow of the adhesive from the dispensing module to quickly and precisely terminate the bead on the receiving surface.

Unfortunately, known dispensing modules require a tradeoff between repeatability discharging adhesive and sharply cutting off the flow of adhesive. On one hand, many known dispenser modules capable of sharply cutting off the flow of adhesive tend to be more prone to "clogging," in which the adhesive blocks the outlet from the further discharge of adhesive. Clogged dispensing modules must be manually cleaned or replaced, resulting in equipment downtime and significant labor and replacement costs to the manufacturer. On the other hand, many known dispenser modules capable of physically displacing clogged adhesive tend to be more prone to a bead "tailing effect," in which the flow of adhesive gradually reduces to terminate the bead. The "tailing effect" refers to the bead tapering to termination due to the more gradual flow reduction. For this reason, manufacturers carefully consider these various tradeoffs when selecting a dispensing module for a particular application.

There is a need for a dispensing module and method for dispensing a viscous liquid that sharply cuts off the flow of viscous liquid and inhibits clogging while addressing issues such as those discussed above.

SUMMARY

An exemplary embodiment of a dispensing module for dispensing an adhesive comprises a dispenser body assembly having an liquid supply passage extending therethrough, a nozzle member, a valve element, and a valve seat. The nozzle member includes a liquid passageway extending therethrough that fluidly connects to the liquid supply passage. The liquid passageway includes a discharge passageway defining an outlet, a first converging surface tapering conically toward the outlet, a bore extending toward the outlet, and a shoulder. The shoulder is positioned between the first converging surface and the bore. The valve element extends along an axis within the liquid passageway and includes a bulbous end portion movable along the axis between an open position and a closed position. The bulbous end portion has a valve needle distally projecting therefrom along the axis. The valve needle is sized smaller than the bore to inhibit obstruction to the discharge passageway for adhesive flowing thereto. The valve seat is defined by an intersection between the shoulder and the second converging surface as a circular line of contact. The circular line of contact seals against the bulbous end portion in the closed position such that at least a region of the valve needle projects into the discharge passageway. Accordingly, the valve needle inhibits clogging of the adhesive proximate to the outlet.

In use, an adhesive module dispenses an adhesive with a nozzle and a valve element. The nozzle includes a liquid passageway and the valve element extends along an axis. The valve element has a bulbous end portion movable along the axis between an open position and a closed position. The bulbous end portion has a valve needle distally projecting therefrom along the axis. Accordingly, the method of dispensing the adhesive includes forcing the adhesive through a discharge passageway of the liquid passageway while the bulbous end portion of the valve element is in the open position. In turn, adhesive discharges from an outlet of the discharge passageway. The method also includes moving the valve element from the open position toward the closed position and moving the valve needle through the bore toward the discharge passageway while inhibiting obstruction of the discharge passageway as the valve needle moves through the bore. Furthermore, the method includes moving the valve element to the closed position to generate a localized pressure within the adhesive and cutting off the adhesive discharging from the outlet. In addition, the method includes inserting at least a region of the valve needle into the discharge passageway to inhibit clogging of the adhesive proximate to the outlet.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
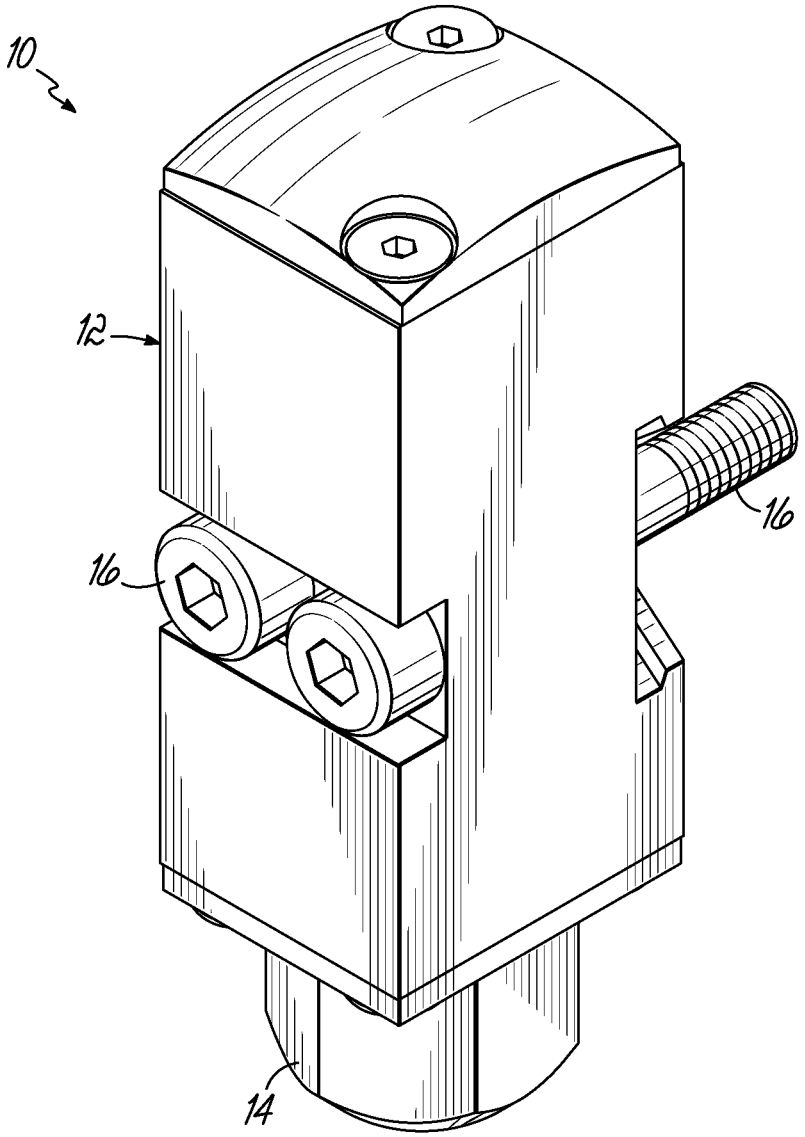
FIG. 1 is a perspective view of an embodiment of a dispensing module in accordance with the invention.
Figure 2:
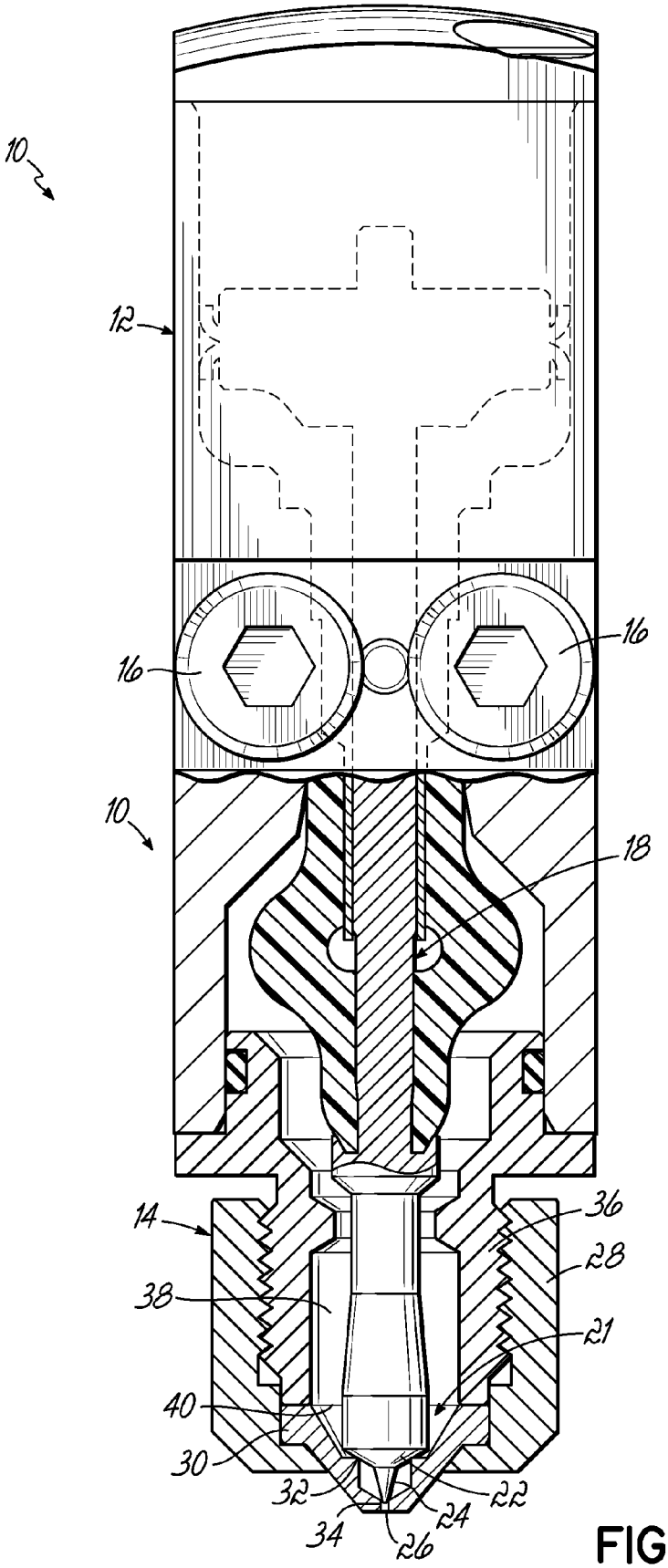
FIG. 2 is a sectional view of the dispensing module of FIG. 1.

FIG. 1 illustrates an exemplary embodiment of a dispensing module 10 for dispensing an adhesive or other viscous liquid. The dispensing module 10 includes a dispenser body assembly 12 and a nozzle 14 from which adhesive or other liquid is dispensed. The dispenser body assembly 12 also includes a plurality of fasteners 16, such as bolts, for connecting the dispensing module 10 to a manifold or body (not shown). FIG. 2 shows a needle 18, or other valve element, operatively connected to the dispenser body assembly 12 to reciprocate along an axis 20 (see FIG. 3A) between a proximal, open position and a distal, closed position. With respect to the use of the terms "distal" and "proximal," it will be appreciated that such directions are intended to describe relative locations along exemplary embodiments of the dispensing module 10. It is not intended that the terms "distal" and "proximal" limit the invention to any of the exemplary embodiments described herein.

The needle 18 has an elongated shaft 19 tapering to a needle tip 21 having a bulbous end portion 22 proximate to the nozzle 14. The bulbous end portion 22 includes a valve needle 24 distally projecting therefrom along the axis 20 (see FIG. 3A) toward an outlet 26 of the nozzle 14. The needle 18 extends through a needle guide (not shown) that constrains the needle 18 to perform substantially linear reciprocation relative to dispenser body assembly 12 with an insignificant amount of lateral displacement or deflection of its elongated shaft. The nozzle 14 includes a nozzle cap 28 and a nozzle insert 30 positioned within the nozzle cap 28 that carries a valve seat 32 described below in greater detail. The bulbous end portion 22 selectively engages the valve seat 32, in association with the axial movement of the needle 18, for controlling the flow of adhesive through a discharge passageway 34. The adhesive is repeatedly discharged from the outlet 26 of the discharge passageway 34 for dispensing a bead of adhesive precisely and without undue clogging or tailing. As described herein, the term "bead" generally refers to a continuous discharge of the adhesive, or any other viscous liquid, on a receiving surface with a desirable length, height, width, or other dimension. In addition, the term "tailing" refers to the bead tapering to termination. According to the exemplary embodiment, the dispensing module 10 and dispenser body assembly 12 are described in additional detail in U.S. Pat. No. 8,333,307, filed Oct. 6, 2009, assigned to the assignee of the present invention, and the disclosure of which is hereby incorporated by reference herein.

Figure 3A:
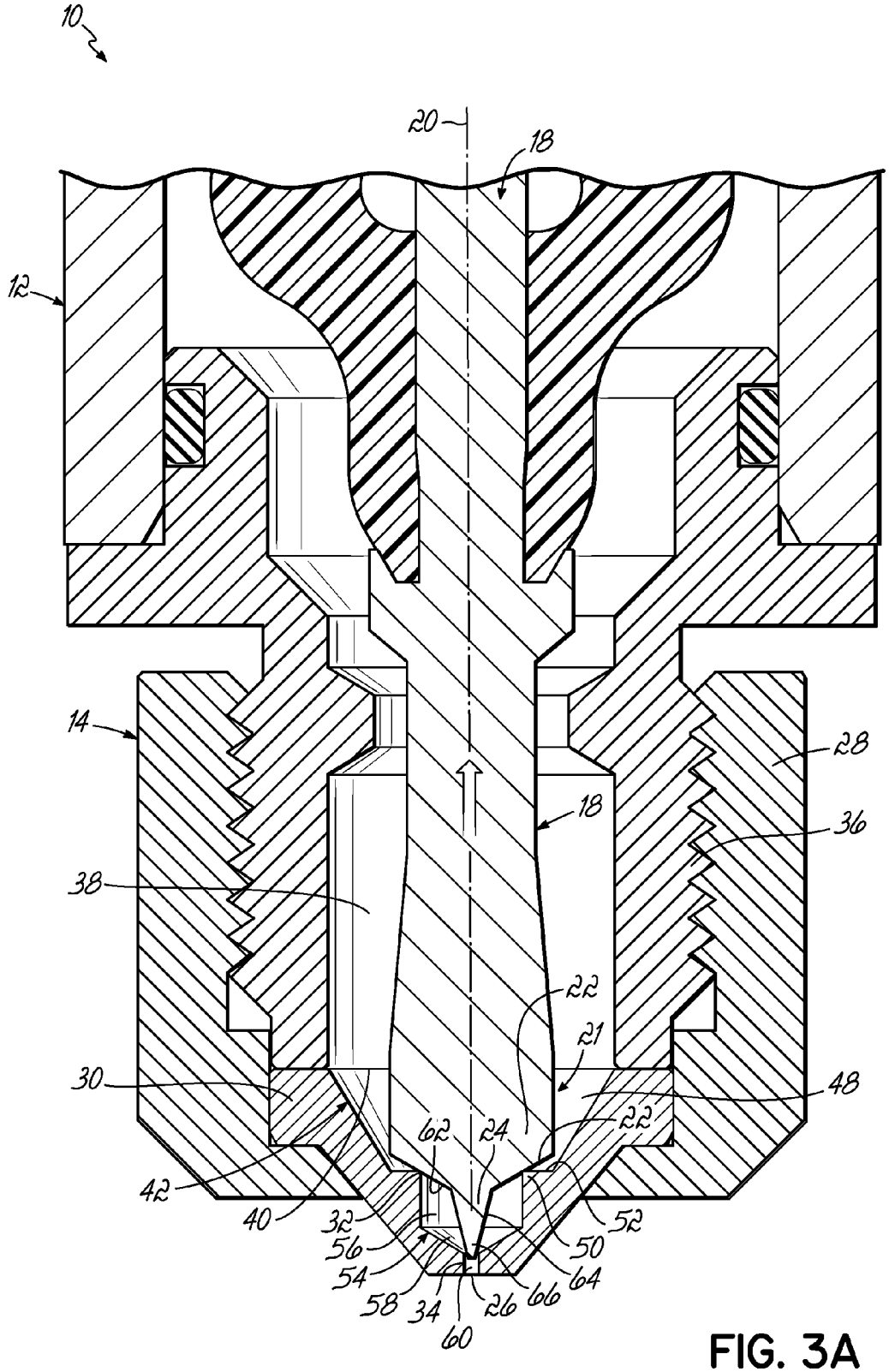
FIG. 3A is an enlarged view of the dispensing module of FIG. 2 having a valve element in a closed position.

With respect to FIG. 2 and FIG. 3A, the dispenser body assembly 12 further includes a distal threaded end portion 36 and defines a liquid supply passage 38 extending therethrough to fluidly connect to an inlet 40 of the nozzle insert 30. More particularly, the nozzle cap 28 is removably connected to the threaded end portion 36 and secures the nozzle insert 30 against the threaded end portion 36 of the dispenser body assembly 12.

The nozzle insert 30 defines a liquid passageway 42 extending therethrough from the inlet 40 to the discharge passageway 34 defining the outlet 26. Accordingly, liquid adhesive flows through the liquid supply passage 38, the liquid passageway 42, and the discharge passageway 34, to be dispensed from outlet 26 when the needle 18 is disengaged from the valve seat 32. Accordingly, the nozzle 14 and the needle 18 collectively provide a dispensing valve for controlling the flow of adhesive from the outlet 26.

Figure 3B:
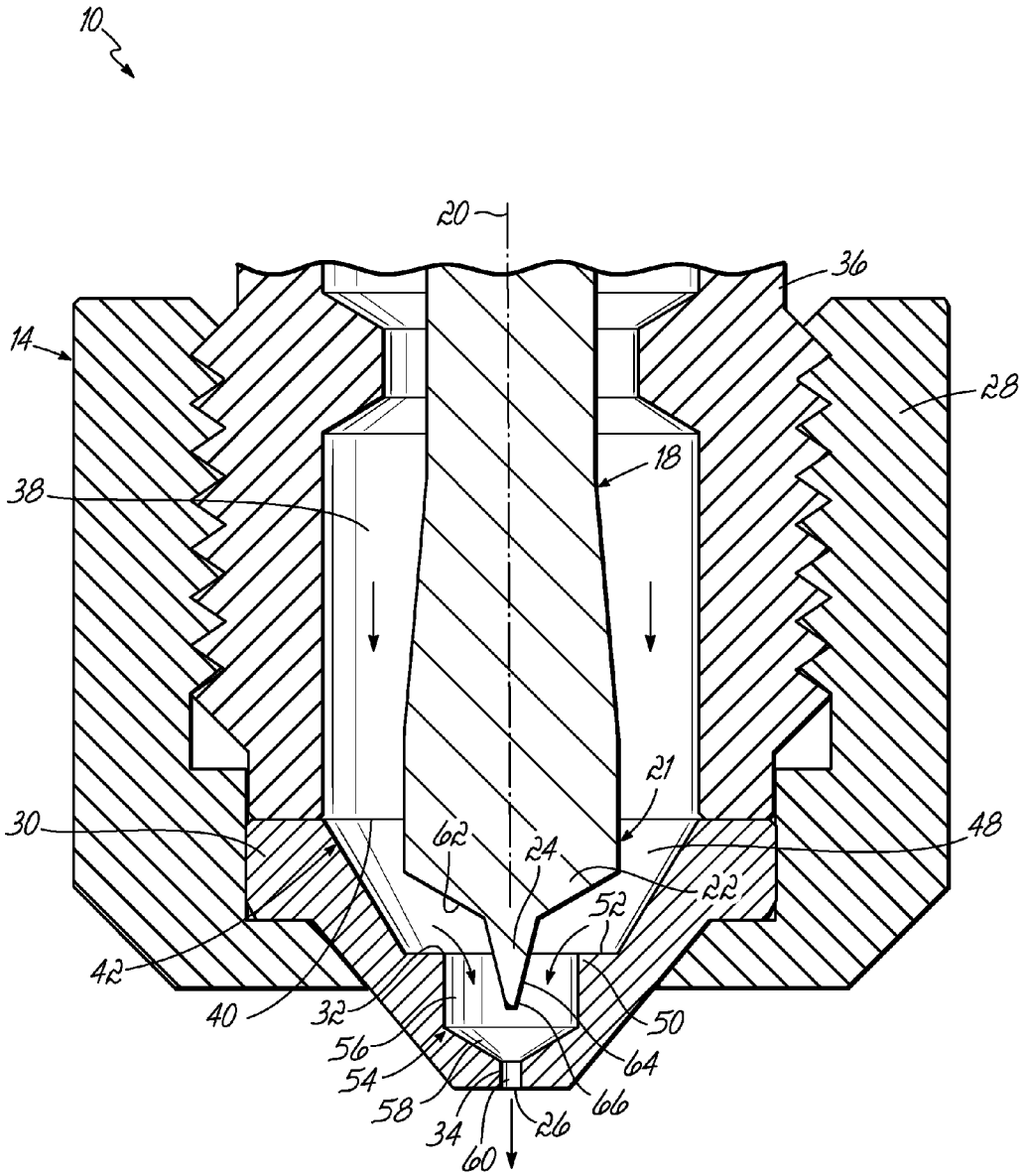
FIG. 3B is similar to FIG. 3A, but shows the valve element in an open position.

More particularly, as shown in FIG. 3A and FIG. 3B, the liquid passageway 42 is defined by a plurality of inner bores or surfaces within the nozzle insert 30. The nozzle insert 30 includes a proximal converging surface 48 extending from the inlet 40 to a shoulder 50 carrying the valve seat 32. More particularly, the proximal converging surface 48 is in the form of a proximal frustoconical surface. The shoulder 50 has a planar annular surface 52 facing toward the nozzle insert 30. The valve seat 32 is further defined by an intersection between the shoulder 50 and a bore 54. Accordingly, the valve seat 32 provides a sharp circumferential edge that defines a circular line of contact with the bulbous end portion 22 of the needle 18. Accordingly, the valve seat 32 provides a sharp circumferential edge that defines a circular line of contact with the needle tip 21. It will be appreciated that the term "circular line of contact" may refer to a circular line of generally any width. For example, the circular line of contact may be a thin circular line having a relatively small amount of surface area or a thick circular line of contact having a relatively large amount of surface. According to an exemplary embodiment, the sharp circumferential edge defines a relatively thin circular line of contact.

The valve seat 32 is centered or coaxial with, and radially symmetric relative to the axis 20. More particularly, the bore 54 includes a proximal cylindrical surface 56 extending between the shoulder 50 and a distal converging surface 58. More particularly, the distal converging surface 58 is in the form of a distal frustoconical surface. The distal converging surface 58 extends to the discharge passageway 34, which is defined by a distal cylindrical surface 60.

With respect to the needle 18, the bulbous end portion 22 includes a first converging valve surface 62 that tapers toward the outlet 26 to the valve needle 24 and defines a bulbous diameter larger than a diameter of the remaining proximal portion of the needle shaft 19. More particularly, the first converging valve surface 62 is in the form of a first frustoconical valve surface. Also, the valve needle 24 includes a second converging valve surface 64. More particularly, the second converging valve surface 64 is in the form of a second frustoconical valve surface. The first and second converging valve surfaces 62, 64 form a compound angle and terminate at a blunt apex 66. A circumferential portion of the first converging valve surface 62 contacts the valve seat 32 to create the circular line of contact, because the bulbous diameter is larger than the valve seat 32. Accordingly, the first converging valve surface 62 and valve seat 32 provide a sealing engagement in the distal position that defines a volume of the liquid passageway 42 closed from the inlet. In other words, the needle 18 seals against the nozzle insert 30 and blocks the flow of adhesive moving along the liquid passageway 42 toward the outlet 26. Each of the first and second converging valve surfaces 62, 64 are centered along, and radially symmetric or coaxial about the axis 20.

Furthermore, in the closed position of FIG. 3A, the valve needle 24 projects through the bore 54 and at least partially inserts into the discharge passageway 34 to inhibit clogging of the adhesive proximate to the outlet 26. Notably, the valve needle 24 is sized smaller than the bore 54 to move through the bore 54 and inhibit obstruction of the discharge passageway 34 as the apex 66 moves through the bore 54 toward the discharge passageway 34. The valve the needle 24 tapers from the bulbous end portion 22 to the apex 66 with an average needle diameter defined therebetween, whereas the bore 54 defines a bore diameter. Accordingly, the bore diameter is relatively large as compared to the needle diameter such that the flow of adhesive continues to move generally unobstructed around the valve need 24 and into the discharge passageway 34 while the apex 66 is within the bore 54. More particularly, the region of the bulbous end portion 22 that extends into the bore 54 has a displacement volume relative to a volume of the bore 54. The relationship between the displacement volume and the volume of the bore defines a predetermined ratio configured for inhibiting obstructed flow of adhesive as the apex 66 passes through the bore 54. For example, the predetermined ratio ranges from 0.78 to 0.80 and, more particularly, is approximately 0.79.

In use, the needle 18 moves proximally from a closed position, as indicated by arrow 70 of FIG. 3A, to an open position shown in FIG. 3B. A pump system (not shown) operatively pressurizes the adhesive to force the adhesive through the inlet 40, along the liquid passageway 42, and from the outlet 26 to discharge adhesive in the form of a bead. The needle 18 moves from the open position toward the closed position such that the valve needle 24 moves through the bore 54 toward the discharge passageway 34 while inhibiting obstruction of the discharge passageway 34. Accordingly, pressurized adhesive flows generally unobstructed around the valve needle 24 and into the discharge passageway 34.

As the bulbous end portion 22 approaches the valve seat 32 the apex 66 of the valve needle 24 similarly approaches the discharge passageway 34 and inserts into the discharge passageway 34 to inhibit clogging of the adhesive or physically unclog adhesive proximate to the outlet 26. Similarly, at least a region of the bulbous end portion 22 extends into the bore 54 prior to contacting the valve seat 32. Accordingly, the the distally moving bulbous end portion 22 engages the valve seat 32 and generates a localized pressure within the adhesive positioned within the bore 54. The localized pressure in turn causes positive displacement of the adhesive around the apex 66 simultaneously located within discharge passageway 34 and sharply cuts off the adhesive from the outlet 26. In this way, the bulbous end portion 22 generates the localized pressure to inhibit tapering of the adhesive while the valve needle inhibits clogging of the discharge passageway 34.

Figure 4:
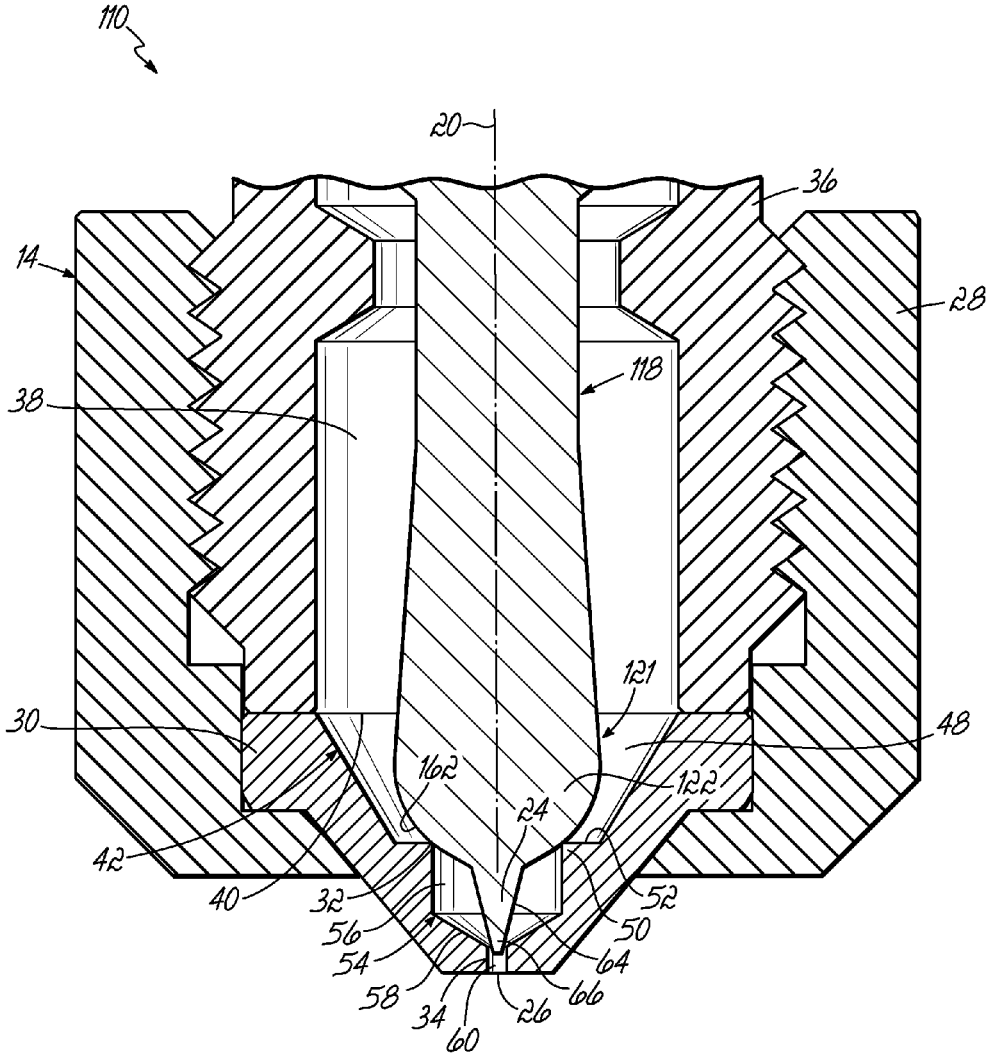
FIG. 4 is an enlarged sectional view of an alternative embodiment of a dispensing module in accordance with the invention.

With respect to FIG. 4, an alternative embodiment includes a dispensing module 110 having the dispenser body assembly 12 and the nozzle 14. In this respect, like numbers indicate like features described above. The dispensing module 110 further includes a needle 118 with the needle tip 121. The needle tip 121 includes a bulbous end portion 122 with a rounded valve surface 162 rather than the first converging valve surface 62 (see FIG. 3A). More particularly, the rounded valve surface 162 is in the form of a spherical valve surface. Similar to the first converging valve surface 62, at least a region of the rounded valve surface 162 extends into the bore 54 to generate the localized pressure for discharging and cutting off the adhesive. It will be appreciated that the bulbous end portion 122 may be any such shape that engages the valve seat 32 while extending into the bore 54. Thus, the bulbous end portions 22, 122 shown in FIGS. 3A-4 are not intended to be limited to the converging and rounded surfaces described herein. Similarly, the dimensions of the bore 54 and valve needle 24 may vary in accordance with the invention so long as the valve needle 24 is sized relative to the bore 54 to inhibit obstruction of the discharge passageway 34. Thus, it will be further appreciated that the bore 54 and valve needle 24 are not limited to the shapes described herein.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. A method of dispensing an adhesive from an adhesive module having a nozzle and a valve element, the nozzle including a liquid passageway and the valve element extending along an axis and having a bulbous end portion movable along the axis between an open position and a closed position, the bulbous end portion having a valve needle distally projecting therefrom along the axis, the method comprising;

forcing the adhesive through a discharge passageway of the liquid passageway while the bulbous end portion of the valve element is in the open position to discharge the adhesive from an outlet of the discharge passageway;

moving the valve element from the open position toward the closed position and moving the valve needle through a bore toward the discharge passageway while inhibiting obstruction of the discharge passageway as the valve needle moves through the bore;

moving the valve element to the closed position to generate a localized pressure within the adhesive and cutting off the adhesive discharging from the outlet; and inserting at least a region of the valve needle into the discharge passageway to inhibit clogging of the adhesive proximate to the outlet.

2. The method of claim 1 further comprising:

extending a region of the bulbous end portion into the bore while moving the valve element toward the closed position to further generate the localized pressure within the adhesive.

3. The method of claim 1 further comprising:

unclogging the discharge passageway of adhesive with the valve needle.

4. The method of claim 1 wherein the bulbous end portion of the valve element generates the localized pressure and the valve needle inserts into the discharge passageway simultaneously in the closed position.

* * * * *